US011759824B2

(12) United States Patent
Rautakoski et al.

(10) Patent No.: US 11,759,824 B2
(45) Date of Patent: Sep. 19, 2023

(54) SCREEN MODULE AND A SCREEN COMPRISING SCREEN MODULES

(71) Applicant: Tana Oy, Jyväskylä (FI)

(72) Inventors: Kari Rautakoski, Leppävesi (FI); Eetu Tuovinen, Jyväskylä (FI); Jarkko Ruotsalainen, Vaajakoski (FI)

(73) Assignee: TANA OY, Jyväskylä (FI)

( * ) Notice: Subject to any disclaimer, the term of this patent is extended or adjusted under 35 U.S.C. 154(b) by 0 days.

(21) Appl. No.: 17/626,040

(22) PCT Filed: Jul. 8, 2020

(86) PCT No.: PCT/FI2020/050488
§ 371 (c)(1),
(2) Date: Jan. 10, 2022

(87) PCT Pub. No.: WO2021/009411
PCT Pub. Date: Jan. 21, 2021

(65) Prior Publication Data

US 2022/0250120 A1 Aug. 11, 2022

(30) Foreign Application Priority Data

Jul. 12, 2019 (FI) ..... 20195633

(51) Int. Cl.
*B07B 1/15* (2006.01)
*B07B 1/46* (2006.01)

(52) U.S. Cl.
CPC ..... *B07B 1/15* (2013.01); *B07B 1/4645* (2013.01); *B07B 2201/02* (2013.01)

(58) Field of Classification Search
CPC ..... B07B 2201/02; B07B 1/4645; B07B 1/15
USPC ..... 209/405
See application file for complete search history.

(56) References Cited

U.S. PATENT DOCUMENTS

| | | | | |
|---|---|---|---|---|
| 2010/0018910 | A1* | 1/2010 | Ballman | B07B 1/46 209/352 |
| 2012/0228198 | A1* | 9/2012 | Doppstadt | B07B 9/00 209/243 |
| 2016/0256894 | A1* | 9/2016 | Reeser | A47J 37/044 |

FOREIGN PATENT DOCUMENTS

| | | | | |
|---|---|---|---|---|
| CA | 2213157 | A1 | 2/1999 | |
| CA | 2293844 | A1 * | 6/2001 | B07B 1/15 |
| CA | 2293844 | A1 | 6/2001 | |
| CN | 201157819 | Y | 12/2008 | |
| CN | 206997336 | U | 2/2018 | |
| EP | 2311582 | A1 | 4/2011 | |
| EP | 2322288 | A2 * | 5/2011 | B07B 1/14 |
| EP | 2322288 | A2 | 5/2011 | |

(Continued)

OTHER PUBLICATIONS

Finnish Office Action, Application No. 20195633, dated Jan. 28, 2020.

(Continued)

*Primary Examiner* — Terrell H Matthews
(74) *Attorney, Agent, or Firm* — MacMillan, Sobanski & Todd, LLC

(57) ABSTRACT

A screen according to the invention comprises replaceable screen modules A screen module are detachable from the screen as well as replaceable and attachable to the screen. According to an aspect of the invention, the screen comprises a frame and one or more screen modules which are detachable from the frame of the screen, attachable to the frame of the screen, and/or replaceable.

16 Claims, 6 Drawing Sheets

(56) References Cited

FOREIGN PATENT DOCUMENTS

| | | | | |
|---|---|---|---|---|
| FR | 2938157 | A1 * | 5/2010 | ..... A23N 12/005 |
| FR | 2938157 | A1 | 5/2010 | |
| WO | 03066243 | A1 | 8/2003 | |

OTHER PUBLICATIONS

PCT International Search Report and Written Opinion, Application No. PCT/FI2020/050488, dated Oct. 6, 2020.

* cited by examiner

SCREEN MODULE AND A SCREEN COMPRISING SCREEN MODULES

FIELD OF THE INVENTION

The invention relates to a screen and a screen module for a screen.

BACKGROUND OF THE INVENTION

A screen for sorting materials comprises a disc screen, i.e. a screening surface. The disc screen comprises shaft assemblies for rotating screening elements, such as circular or angular discs or pointed stars, used for screening the materials. The number of shaft assemblies may vary, for example depending on the operating capacity. Shaft assemblies arranged one after another are positioned so that their screening elements are interlocked. The screening elements of a shaft assembly are selected according to the material to be processed. A motor rotates one or more shaft assemblies, and the rotary motion may be transmitted to other shaft assemblies. Screening slots are formed between screening elements of adjacent shaft assemblies. Pieces having a larger size than the screening slots remain on the disc screen, and the rotating screening elements convey the pieces to, for example, a conveyor downstream of the disc screen. Pieces having a smaller size than the screening slots fall through the screening slots of the disc screen, for example, into a funnel or onto a conveyor under the disc screen. The fraction having a larger size than the screening slots is called the oversize fraction, and the fraction having a smaller size is called the undersize fraction. The structure of the screen is designed for a given material and/or particle size used for determining, among other things, the spacing between the shafts and the sizes of the discs. Typically, the screen is used for screening a given constant particle size from a given constant material in a given constant process.

BRIEF SUMMARY OF THE INVENTION

The aim of the invention is to implement a screen module and a modular screen in which the disc screen comprises separate screen modules. The screen modules facilitate the maintenance, servicing and cleaning of the screen. Moreover, the screen modules are replaceable.

A screen according to an aspect of the invention comprises a frame with one or more screen modules which are detachable from the frame of the screen, attachable to the frame of the screen, and/or replaceable.

A screen module according to an aspect of the invention is attachable to the screen. The screen module may comprise at least one positioning element which may be used for putting the screen module in place in the screen.

DESCRIPTION OF THE DRAWINGS

In the following, the invention will be described by means of the appended drawings, in which.

DETAILED DESCRIPTION OF THE INVENTION

Figure 1:
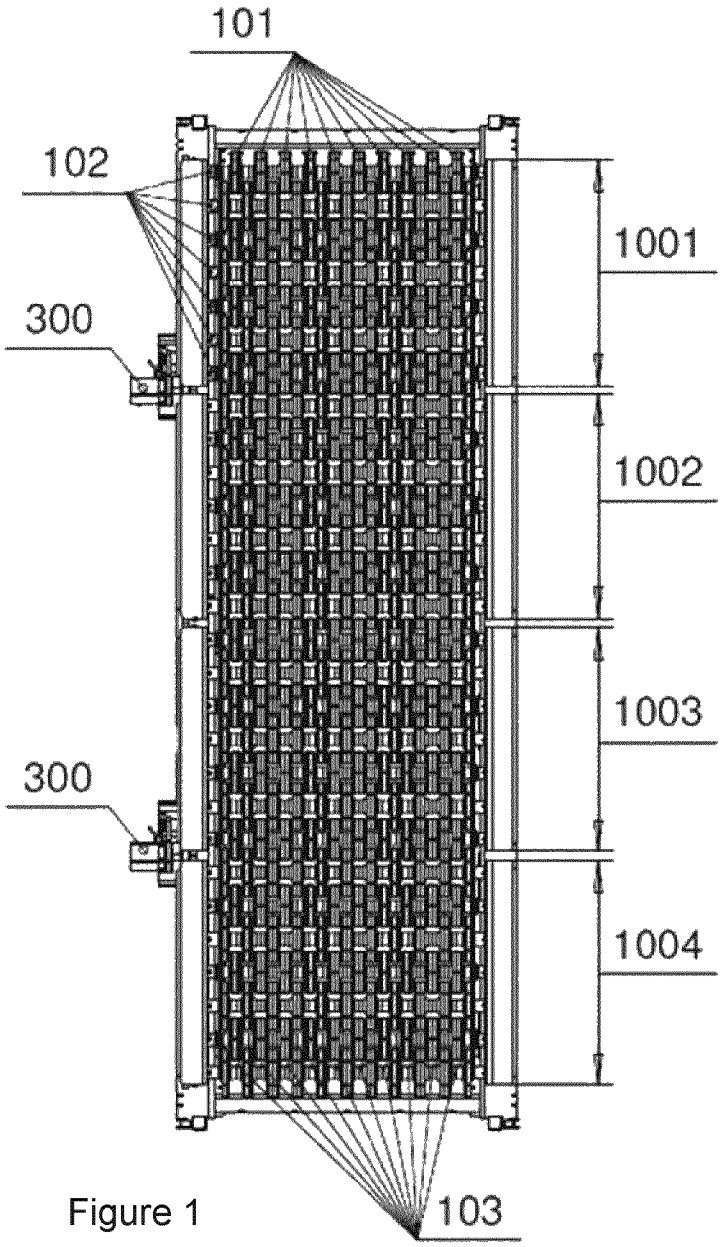
FIG. 1 shows a screen according to an embodiment of the invention in a top view.

FIG. 1 shows a screen according to an embodiment of the invention in a top view. The disc screen comprises separate screen modules 1001, 1002, 1003, 1004. Each screen module 1001, 1002, 1003, 1004 comprises shaft assemblies 102. The shaft assemblies 102 comprise screening elements 101 arranged on shafts. The shaft assemblies 102 are transverse to the longitudinal axis of the screen. The shaft assemblies 102 are rotatable with respect to the rotation axis of the shaft. The screen modules 1001, 1002, 1003, 1004 comprise shaft assemblies 102 arranged one after another so that the screening elements 101 of adjacent shaft elements 102 are interlocked. The screen elements 101 in a single shaft assembly 102 and in a single screen module 1001, 1002, 1003, 1004 are identical, to provide a uniform screening output throughout the area of the screen module. The shaft assemblies 102 are placed one after another in the longitudinal direction of the screen so that screening slots 103 are left between the screening elements 101 of adjacent shaft assemblies 102. The number of shaft assemblies 102 is dependent on the spacing between the shafts. The spacing between the shafts, as well as the machine speed and the size of the screening elements 101, are factors affecting the particle size of the material to be screened. The screening elements 101 may be discs or stars arranged with predetermined spacing in the shaft assembly 102.

The shaft ends of the shaft assemblies 102 are mounted on bearings to enable the rotary motion of the shaft. The bearings may be mounted with brackets to the frame of the screen module. The bearings may be, for example, collar step bearings or pedestal bearings, depending on, for example, the type of the frame of the screen module. A screening element 101 may comprise two castings placed together. In addition to the screening elements 101, the shaft may be provided with sleeves, bushings or other parts which may be used to affect, among other things, the adjustment of lash and the tightness of the sides of the screen module.

The material to be screened is guided to the disc screen. The rotary motion of the screening elements 101 makes it possible for the material to move on the disc screen simultaneously when pieces having a smaller size than the screening slots 103 are screened out under the disc screen where they are collected, for example into a funnel or onto a conveyor. In FIG. 1, the material to be screened is first guided onto the first screen module 1001. The screen modules 1001, 1002, 1003, 1004 may differ from each other with respect to the screening elements 101, their size, and/or their spacing in the shaft assembly 102, and/or the spacing between the shaft assemblies 102. For example, the first screen module 1001 may comprise smaller screening slots 103 than at least one of the following screen modules 1002, 1003, 1004, which enables screening of fine particles by the first screen module 1001.

The screen may comprise screen modules of different types and different sizes. The screen modules are designed and manufactured for a given material and/or particle size to be processed. One screen module may be used for processing a single material and/or particle size. By replacing the screen modules, the screen may be quickly configured for a different material and/or particle size.

In FIG. 1, two adjacent screen modules are driven by a single motor. The shaft assemblies 102 of the first two screen modules 1001, 1002 are rotated by a first motor 300. The shafts of the latter two screen modules 1003, 1004 are rotated by a second motor 300. Alternatively, one motor may be provided for each module, or for the whole disc screen. One or more motors 300 are coupled to the frame of the screen. One or more motors 300 may be a hydraulic motor or an electric motor. The motor(s) 300 is (are) placed on one longitudinal side of the screen. This side may be called the drive side of the screen. The screen may be maintained and adjusted from the opposite side which may be called the maintenance side of the screen.

Figure 2:
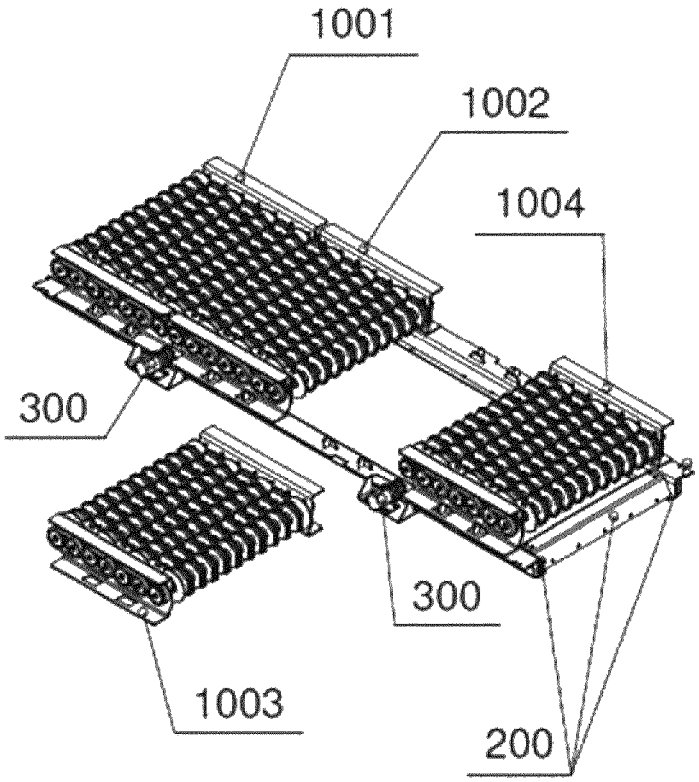
FIG. 2 shows a screen according to an embodiment of the invention.

FIG. 2 shows a screen according to an embodiment. In FIG. 2, three screen modules 1001, 1002, 1004 are installed in the frame 200 of the screen, and one module 1003 is detached from the frame 200. Each of the screen modules is detachable and replaceable. When detaching the screen module, the motor 300 with its transmission to one or more shaft assemblies is disengaged, after which the screen module may be detached from the frame 200, for example by means of forks. In this way, a single screen module may be detached from the screen, for example for maintenance. The screen module may also be replaced with a different screen module. In this way, the screen may be modified for a different use. The numbers, sizes and types of shaft assemblies and discs may be selected according to the type and the quality of the raw material to be screened. Factors affecting the particle size of the material include the rotational speed of the shaft assemblies as well as the dimensions of the shaft assemblies and the discs. The dimensions have an effect on the sizes of the screening slots, and the rotational speed has an effect on the behaviour of the material, for example its mixing. The particle size of the material, in turn, has an effect on the use properties and further use of the screened material.

FIG. 2 shows four screen modules 1001, 1002, 1003, 1004. The number of screen modules may vary, for example, from 1 to 6. A plurality of screen modules makes it possible to detach, maintain, adjust, or replace smaller units, i.e. the screen modules. In this way, the maintenance, adjustment and other servicing work may be conducted away from the screen. In this way, more space is available, which enables e.g. the safer use of various equipment. It is possible to replace a screen module with a different one, or to replace two or more screen modules with a single one. For example, in FIG. 2, the middle modules 1002, 1003 or all the screen modules may be replaced with a single screen module. Alternatively, one screen module may be replaced with two or more screen modules. If a reserve module is available for one or more detached screen modules, it may be installed in place of the detached one in the screen. In this way, the screen may be operated and it does not have to be shut down for the time of the maintenance.

In screen structures of prior art, the detachable unit may be a shaft assembly with screening elements. If, for example, discs used as screening elements have to be replaced, their shaft assembly (assemblies) must be detached from the screen frame, after which the discs may be replaced. The detachment and re-attachment of the shaft assembly is laborious and time-consuming. Furthermore, a number of maintenance and installation operations have to be performed on the disc screen where little space is available and working is not safe. Moreover, the operation of the screen has to be shut down for the time of the maintenance.

Figure 3:
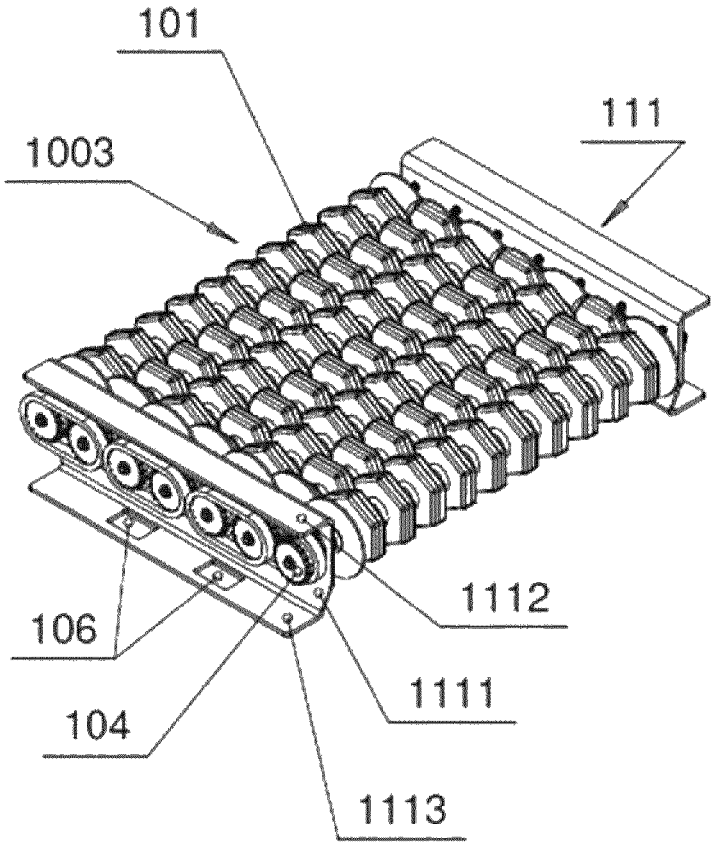
FIG. 3 shows a screen module according to an embodiment of the invention.

FIG. 3 shows a screen module according to one embodiment of the invention. A screen module 1003 comprises discs 101 as screening elements in a shaft assembly. Shaft assemblies are placed one after another so that the discs 101 of adjacent shaft assemblies are interlocked. The shaft assemblies are fastened to walls 111 or an edge part of the screen module. The opposite walls 111 may be identical on both the maintenance side and the drive side. In FIG. 3, the wall of the screen module comprises an upper edge 1112, a lower edge 1113, and a side edge 1111 connecting these. The upper edge 1112 and the lower edge 1113 of the wall may be substantially horizontal, and they may be connected by a substantially vertical side edge 1111. The lower edge 1113 of the wall is placeable against the frame of the screen so that positioning elements of the frame are placed against positioning elements 106 of the wall. The wall 111 of the screen module, namely its lower part 1113, is provided with positioning elements 106 which are placeable in or against mating parts in the frame of the screen. The screen module 1003 is placeable in its place with respect to the frame of the screen by means of the positioning elements 106. The frame of the screen is equipped with corresponding positioning elements which constitute mating pairs for the positioning elements 106 of the screen module.

Figure 4:
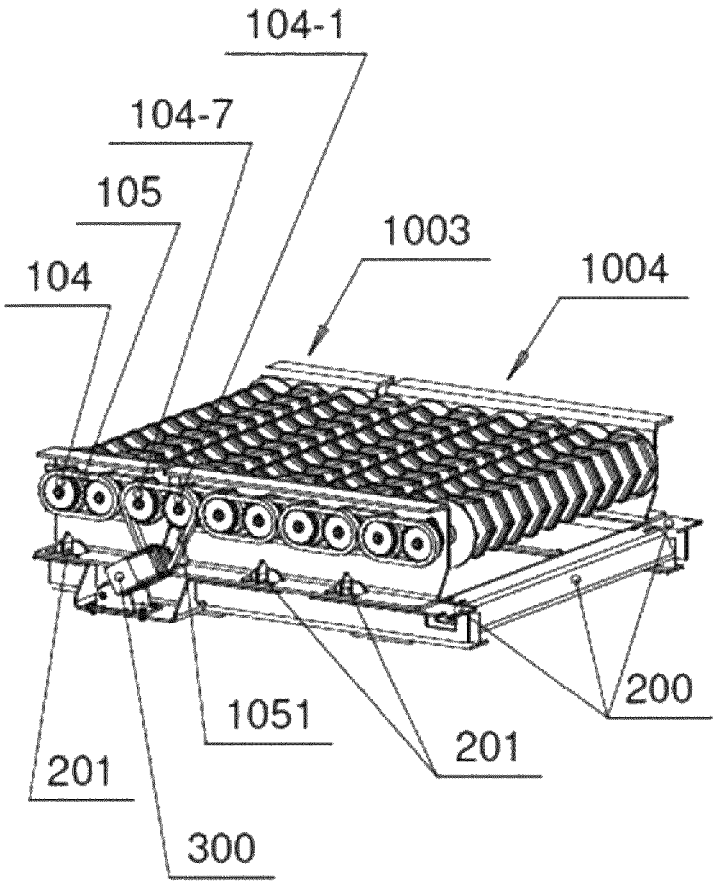
FIG. 4 shows screen modules according to an embodiment of the invention.

FIG. 4 shows screen modules according to an embodiment of the invention. The screen modules 1003, 1004 are fastened to the frame of the screen. In FIG. 4, the screen modules 1003, 1004 are positioned in the frame 200 by means of positioning elements 201 of the frame, in which the positioning elements of the screen modules are placed, forming mating parts for the positioning elements 201 of the frame. At the end of each shaft assembly, a drive element 104, such as a double strand sprocket, is provided in the screen module. The drive elements 104 are connected to each other to be rotatable 105, for example by a belt or a chain. The drive element 104 in FIG. 4 may be a sprocket, a belt pulley, a cogged wheel, or the like, for transmitting the rotary motion to a single shaft. Alternatively, each shaft may be provided with a separate driving motor, for example an electric motor or a hydraulic motor, and, for example, a clutch for power transmission.

In FIG. 4, two adjacent screen modules 1003, 1004 are driven by a motor 300. The drive wheel of the motor 300 is connected to the adjacent drive elements 104-7, 104-1 of the adjacent screen modules 1003, 1004. The drive element 104-7 of the last shaft assembly of the module 1003 and the drive element 104-1 of the first shaft assembly of the screen module 1004, placed adjacent to each other, are connected to the drive wheel of the motor 300 by means of a transmission 1051. The transmission 1051 may be a chain or a corresponding element for transmitting a rotary motion. In this way, the single motor 300 may be used for driving two adjacent screen modules 1003, 1004. In a corresponding way, a single motor may be used for driving a plurality of screen modules whose shaft assemblies are connected to each other to be rotatable.

For two screen modules, one motor 300 may be provided, whose torque is transmitted to adjacent shaft assemblies of adjacent screen modules. The motor 300 may drive or rotate the outermost shaft of the module, from where the rotary motion is transmitted by a transmission 105, for example belts, cogging, or transmission chains, to the other shaft assemblies of the screen module. In FIG. 4, the motor 300 is fastened to the adjacent, outermost shafts of two adjacent screen modules, from which the power is transmitted to the other shafts of the screen modules.

The motor 300 and the motor transmission 1051 may be disengaged, for example by quick-release. The motor transmission 1051 is disengaged before the screen module 1003, 1004 is detached from the frame 200. The same or a different screen module may be re-installed in the frame, after which the motor transmission 1051 may be installed in the structure. The type and the size of the screen module may vary. In a case where two screen modules 1003, 1004 are replaced with a single screen module, the motor 300 may be left uninstalled or unused, if the replacing single screen module is driven by another motor of the frame 200. The second motor of the frame 200 may drive one or more screen modules, if necessary.

The frame 200 is provided with positioning elements 201, by means of which the screen modules may be placed and/or kept in place with respect to the frame. The positioning elements 201 of the frame 200 are arranged to be placed against the positioning elements 106 of the screen module. The positioning elements 106 of the screen modules constitute counterparts for the positioning elements 201 of the frame. The screen module may be fastened to the frame by means of the positioning elements of the screen module and the frame. The positioning elements 106 of the screen modules may be openings, recesses, protrusions, or shaped parts so that they constitute counterparts for the positioning elements of the frame 201, which may be protrusions, recesses or shaped parts. The frame 200 of the screen has a predetermined size. The frame comprises one or more motors 300 as well as positioning elements 201 for positioning the modules.

In FIG. 4, the positioning element 201 of the frame comprises two crosswise plate-like elements tapering in the upwards direction. The positioning elements 106 of the screen module comprise openings whose edges are placed against the crosswise parts of the positioning element 201 and the frame. In this way, the screen module takes its position, the lower part of the side wall abutting the frame 200, and remains in its position against the frame 200. The crosswise positioning element 201 may prevent the movement of the screen module in the longitudinal and transverse directions of the screen. The upwards tapering positioning elements 201 may facilitate their insertion through the mating openings acting as the positioning elements 106 of the screen module. In this way, the positioning elements 201 may be configured to guide the screen module into its place in the frame 200. Alternatively, the frame 200 may comprise openings, and the screen module may comprise positioning elements which are placed in the openings in the frame 200. Alternatively, both the frame 200 and the screen module may comprise positioning elements which are mated. The positioning elements may be welded in the frame 200 and/or the screen module. The positioning elements may be counterparts, openings, pins, holes, cotter pins, or corresponding parts or elements. For example, the positioning element may be an opening in the frame, and its counterpart may be a pin-like part in the screen module, or vice versa. Also, openings may constitute positioning elements to be mated. The edges of the openings may be provided with a projection, protrusion or a design for positioning and/or placing the openings against each other. The positioning elements may keep the screen module, or the part of its wall facing the frame, in its place with respect to the frame, in both the longitudinal direction and the cross direction of the frame. The positioning elements may be used for fastening the screen module to the frame. The positioning elements may comprise an opening for receiving a fastening device. The fastening device may be used for fastening the screen module to the frame. The fastening device may be a screw, a bolt, or a corresponding mechanical fastening device. In addition or alternatively, the screen module may be fastened to the frame of the screen by means of a side plate of the frame which may be lifted and lowered against the screen module. The screen module may be locked in place with respect to the frame by means of the positioning elements. The screen module may be pressed down and locked in place by means of a side plate, such as a lateral side plate, of the screen. The side plate of the screen and the side plate of the screen module are designed to be compatible.

In FIG. 4, the drive elements at the ends of the shafts may be sprockets 104. The sprockets 104 are double stranded, and they are connected to each other so that the inner wheel of the double strand sprocket 104 is connected by a chain to the inner wheel of the adjacent sprocket, and the outer wheel of the sprocket 104 is connected by a chain 105 to the outer wheel of the adjacent sprocket. The inner and outer wheels of the sprocket 104 are coupled to the adjacent wheels on different sides of the sprocket 104; for example, the inner wheel and the outer wheel are coupled to the corresponding parts of the preceding and following sprockets, respectively. In this way, the shaft assemblies of the screen module are coupled to each other in a rotatable way, and the driving force may be transmitted between the shaft assemblies. The rotation of a single shaft assembly transmits the rotary motion to the shaft assemblies coupled to it. Instead of double strand sprockets, it is possible to use single strand sprockets. The sprockets may be coupled to each other in a rotatable way by, for example, one chain. Each screen module may be provided with its own drive, or each shaft assembly may be driven separately. A shaft assembly specific motor provides the shaft assembly with a drive of its own. The centralized chain drive shown in FIG. 4 is simpler and cheaper to implement than shaft assembly specific motors. Instead of a chain, a belt, or a corresponding transmission between the wheels, the shaft assemblies may be coupled to each other in a rotatable way by means of cogging of the wheels at their ends, and cogwheels. The shaft assemblies may be arranged to be belt-driven or chain-driven. If a single motor is arranged to drive a plurality of shaft assemblies, the drive may be implemented by means of belts and wheels, chains and sprockets, or cogwheels. Double strand wheels make it possible to connect all the shaft assemblies of a single screen module to each other, for example by means of chains or belts. When a screen module whose shaft assemblies are coupled to each other is placed in a screen, the drive of all the shaft assemblies in the screen module is provided by connecting one sprocket to a drive motor for power transmission. This makes it simpler and faster to replace and maintain the screen module, and to change the screening configuration.

Figure 5:
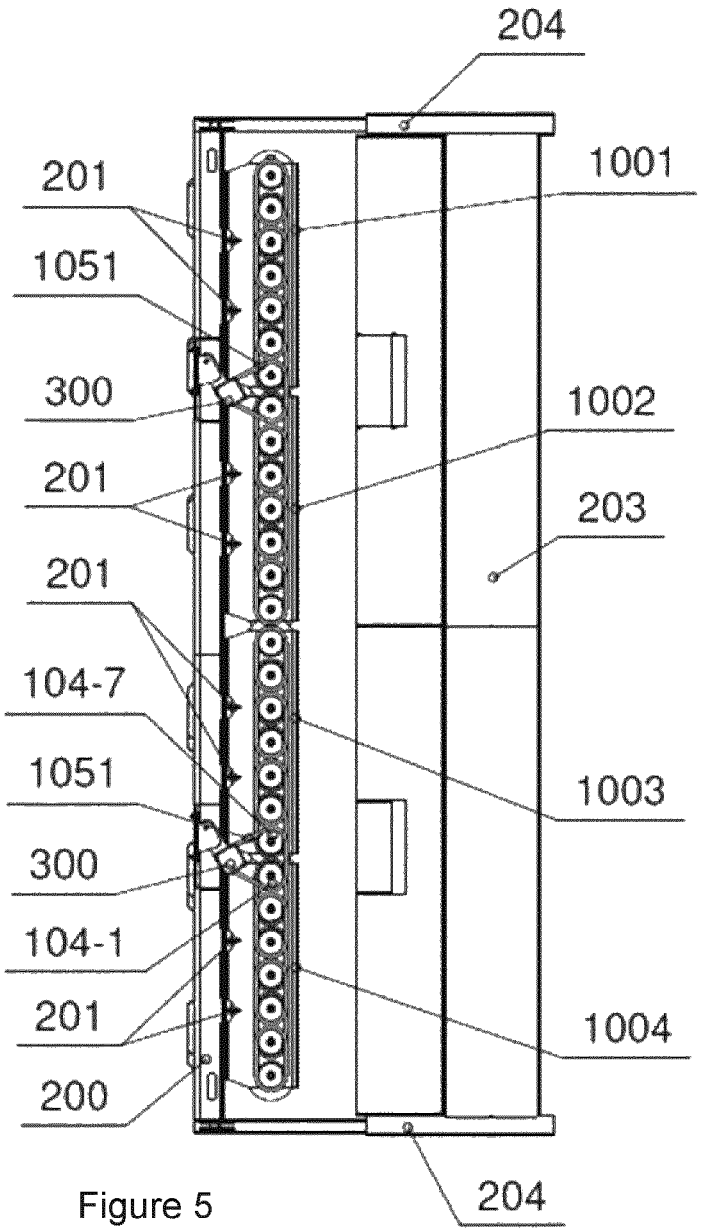
FIG. 5 shows a screen according to an embodiment of the invention in a side view.

FIG. 5 shows a screen according to one embodiment of the invention in a side view. The screen modules 1001, 1002, 1003, 1004 are received in the frame 200 by means of the positioning elements 201 of the frame and their counterparts, i.e. the positioning elements of the screen modules. The motors 300 and their transmission 1051 are engaged for driving the screen modules. One motor 300 is used for driving two adjacent screen modules 1001 and 1002; 1003 and 1004. The power is transmitted from the motor 300 to the outermost drive wheels 104-1, 104-7 of the adjacent screen modules by means of the transmission 1051.

The screen comprises an openable side plate 203. In FIG. 5, the openable side plate 203 is open or in its uppermost position. The openable side plate 203 may be the longitudinal plate or the lateral side plate of the screen. The lateral surface of the side plate 203 may be arranged to maintain a substantially transverse position with respect to the level of the disc screen. The lateral surface of the side plate 203 may be movable up and down, for example without tilting of the lateral surface. The upper edge and/or the lower edge of the upright side plate 203 may be movable directly up and down. When lifted/lowered, the side plate 203 may remain in its upright position with respect to the horizontal plane of the disc screen. For manipulating, such as disengaging and engaging, the screen modules and motors 300, the side plate 203 is lifted up. The side plate 203 may be lifted to the upper position and lowered to the lower position by means of lift cylinders 204 at the lateral edges of the lateral side plate 203. The lift cylinders 204 may be, for example, hydraulic cylinders or, alternatively, for example spindle motors or the like, for example based on the power used for driving the machine, such as electricity or hydraulics. When the side plate 203 is lifted in its upper position, as shown in FIG. 5, the motors 300, transmissions and sprockets of the shaft assemblies are accessible at the drive end of the screen. It is thus also possible to disengage, remove, install, put in place, and fasten the screen modules. When the side plate 203 is lifted up, one or more specific screen modules may be removed by disengaging the transmission between the screen modules and the motor 300 driving the same. The motor 300 may be provided with a quick-release mechanism, by which the transmission of the motor 300, such as a belt or a chain, may be loosened and further removed from the wheels of the screen module.

After the screen modules have been put in place in the frame by means of the positioning elements 201 and their counterparts, and the motors 300 and their transmission have been coupled for driving the screen modules, the side plate 203 of the frame may be lowered to the lower position. In the lower position, the side plate 203 protects the parts at the drive end, such as the sprockets at the ends of the shaft assemblies, the motors, the transmissions, and the positioning elements. Furthermore, in the lower position, the side plate 203 constitutes the edges for the disc screen. By means of the lateral side plate 203, the screen modules may be pressed tightly against the frame, whereby they remain in place in the height direction of the screen. This is shown in more detail in the following FIG. 6.

Figure 6:
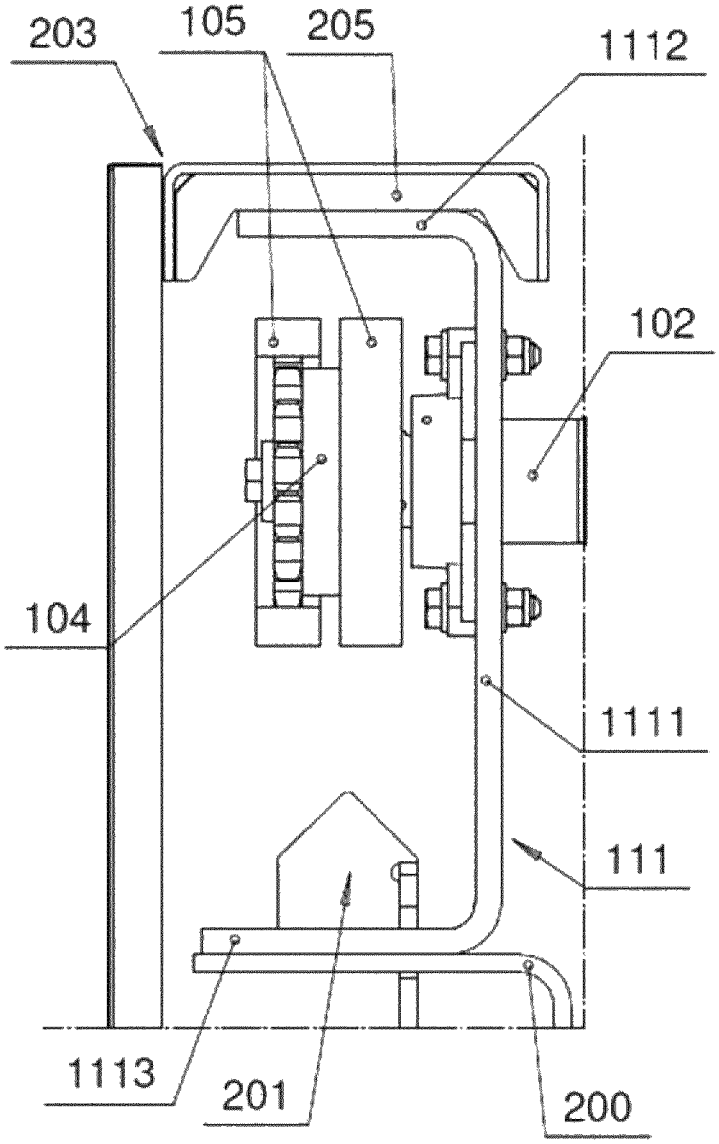
FIG. 6 shows a screen module according to an embodiment of the invention, installed in a frame.

FIG. 6 shows a screen module placed in the frame, according to an embodiment of the invention. The wall 111 of the screen module may be C-shaped. The upper part 1112 and the lower part 1113 of the wall 111, which may both be horizontal, are connected by a lateral part 1111, to which the shaft assemblies 102 are connected, for example by bearings. The drive elements 104 of the shaft assemblies 102 are placed on that side of the wall 111 which is opposite to the screening elements. The drive elements 104 are connected to each other by a transmission 105. The lower edge 1113 of the wall 111 of the screen module is placed against the frame 200, or the edge part of the frame, by means of positioning elements 201 of the frame and their counterparts in the screen module. The lower edge 1113 of the wall remains in place by means of the positioning elements 201 and their counterparts. The side plate 203 of the frame is lowered to the lower position, wherein it encapsulates the drive side of the screen, such as the drive elements 104 of the screen module, their transmission 105, the positioning elements 201, as well as one or more motors.

The side plate 203 constitutes the outermost part on the drive side of the screen, as shown in FIG. 6. A corresponding arrangement including a side plate that may be opened, i.e. lifted and lowered, in the vertical direction of the screen, may be provided on the maintenance side of the screen as well.

The lateral side plate 203 is configured to fix the screen module against the frame 200. The lateral side plate 203 is configured to press the screen module against the frame 200 of the screen. The lateral side plate 203 is equal in length with the longitudinal side of the screen or its frame. The lateral side plate 203 extends from the outermost edge of the screen towards the upper part 1112 of the wall 111 of the screen module, and it may extend to the lateral part 1111 of the wall 111, as shown in FIG. 6. The part of the lateral side plate 203 that is against the upper part 1112 of the wall 111 may press the screen module downwards, the lower part 1113 of the wall 111 against the frame 200. The lateral side plate 203 may thus keep the screen module in place. The part of the lateral side plate 203 that is against the upper part 1112 of the wall 111 may be shaped or equipped with an element 205. In the following, the element 205 will be described, which may thus be a separate or integral part 203 of the lateral side plate. The element 205 is provided between the lateral side plate 203 and the upper part 1112 of the wall 111 of the screen module. The element 205 may extend to the sides adjacent to the upper part 1112 of the wall 111 of the screen module. The element 205 may have the shape of a C or U opening downwards. The element 205 has a bottom part and side parts extending in a substantially transverse direction from the bottom part. The side parts of the element 205 border the upper part 1112 of the wall 111 of the screen module, taking up a position on its one side or both sides. The side parts of the element 205 may have bevelled edges against the corner, side and/or edge parts adjacent to the upper part 1112 of the wall 111. The shape of the element 205 corresponds to the shape of the abutting corner, side and/or edge parts adjacent to the upper part 1112 of the wall 111. The element 205 may be placed tightly against the upper part 1112 of the wall 111 of the screen element, as well as against the abutting corner, side and/or edge. The shape of the element 205 may correspond to the shape of the abutting wall 111. The element 205 enables locking of the screen module against the frame 200. The rotating shaft assemblies 102, their bearings, and motor(s) cause mechanical stress during operation of the screen. Fastening and keeping the screen modules in place enables the utilization of screen modules in the screen. The screen modules may be fastened at the lower part 1113 of the wall 111 to the frame 200 by means of the positioning elements and their counterparts. At the upper part 1112 of the wall 111, the fastening may be provided by means of the lateral side plate 203 and possibly its element 205. The element 205 may comprise steel, such as cut-off steel sheet. The shape of the element 205 may have an effect on the functionality. For example, an element 205 having the shape of a C or U opening downwards may facilitate the positioning of the side plate 203 and its placement against the upper part 1112 of the wall 111.

The openable side plate enables locking of one or more screen modules in place. When the side plate is closed, it constitutes the side/edge of the disc screen, keeping the material to be screened running on the disc screen, or preventing the material from falling off to the side. Furthermore, the openable side plate protects the bearings, sprockets and/or other components needed for driving the shaft assemblies.

The frame structure of the screen with screen modules enables the replacement of screen modules. Replaceability of the screen modules facilitates the maintenance, servicing and cleaning. The removal of screen modules is quick, and detached screen modules may be taken, for example, to a workshop for maintenance, with more space and better facilities for service. The replaceability of the screen modules makes it possible to change the particle size of the screen and to maximize the operating time of the screen. A screen module may be maintained without downtime. It is replaceable with another screen module during the maintenance. The cost of a screen module is only a fraction of the total cost of the screen, and downtime, such as time spent on maintenance, repair and cleaning, eats into the profits. Consequently, it is cost efficient to keep extra screen modules in reserve.

The frame structure of a screen module may comprise one or more units or subunits. For example, a screen module may comprise two lateral plates which enable positioning and locking with a side plate that may be brought down. Alternatively, the structure may comprise a welded structure which allows the material to fall through the disc screen during screening and which is locked with e.g. screws to the frame of the screen. The frame structure of the screen module is compatible with the structure of the frame of the screen. This makes it possible to position the screen module as well as to keep the screen module in place during operation of the screen. The frame structure of the screen module enables quick and easy positioning and locking of the screen to the frame of the screen for use, for example by means of the positioning elements and possible fastening elements. The frame structure of the screen module enables the moving, positioning and manipulating of screen modules by forks, for example by a forklift or a wheel loader. The frame structure of the screen module may enable manipulating of screen modules with a crane or a corresponding device suitable for transferring.

A frame according to the embodiments may comprise different numbers of different screen modules. The screen modules are replaceable with different ones, and their number in the frame may be varied. The length of the disc screen has an effect on the screening output. To provide a longer disc screen, the length of the frame, the number of screen modules, and/or the length of the screen modules may be changed.

Screen modules according to the embodiments enable their detachment and replacement with new or different screen modules. Separate screen modules are quickly and easily detachable from and attachable to the frame. Replaceable screen modules may be used to change the function and/or use of the screen, for example according to the particle size of the material to be processed. The screen modules are components separate from the frame of the screen. They may be positioned on the frame by means of positioning elements in the frame and in the screen modules. The positioning elements of the frame and the screen modules may constitute counterparts to each other. The positioning elements may fasten the lower edge of the wall of the screen module against the frame of the screen in the longitudinal and transverse direction of the frame. In this way, the movement of the screen module in the longitudinal and transverse directions of the frame may be prevented. The screen modules may be locked in place by means of the lateral side plates of the screen which, in their lower position, press the screen modules against the frame of the screen. The shafts of the screen modules are driven by motors mounted on the frame, which may be hydraulic motors. From the motors, the power may be transmitted to the screen modules, or their shafts, for example by means of chains. At the ends of the shaft assemblies, double stranded sprockets may be provided, whereby the chains connecting these may extend from each shaft assembly to the next one. One motor may drive one, two or more screen modules. The motor(s) and the transmission of the motor(s) to the shafts are disengageable. Thus, the screen module is detachable and/or replaceable.

The detachment of single screen modules facilitates the maintenance, servicing and/or cleaning of the screen. A detached screen module is replaceable with a reserve module, whereby the screen can be used during maintenance and/or cleaning. For changing the type of material to be screened or the desired particle size, the screen may be upgraded as needed, by replacing one or more screen modules with one or more different screen modules. For example, the dimensions of the screening elements and the shaft assemblies may be changed. All the screen modules of the screen may be identical. Alternatively, for example, the first screen module may comprise smaller screen slots. In this way, three fractions, instead of two, are obtained as the screening output: so-called fine particles in addition to the oversize fraction and the undersize fraction.

Some embodiments of the invention have been described above. It is possible to carry out different implementations within the scope of the inventive idea. The components presented above may be modified, replaced with other ones or left out to provide a corresponding screen module and to fasten it to the frame of the screen.

The invention claimed is:

1. A screen comprising a frame, and one or more screen modules, which one or more replaceable screen modules comprise shaft assemblies and a wall having an upper part, a lower part, and a side part connecting the upper part and the lower part of the wall, and to which wall the shaft assemblies are connected, wherein the frame comprises an openable side plate which, in its lower position, is configured to lock one or more screen modules against the frame so that the part of the lateral side plate abutting the upper part of the wall presses the screen module downwards and the lower part of the wall against the frame, and, in its upper position, is configured to enable detaching one or more screen modules from the screen, or attaching and replacing one or more screen modules to the frame.

2. The screen according to claim 1, wherein one or more screen modules have different sizes.

3. The screen according to claim 1, wherein the side plate, in its upper and lower position, is configured to remain in an upright position with respect to the horizontal level of the disc screen.

4. The screen according claim 1, wherein one or more screen modules are configured to be detached from the frame to a side of the frame, or installed in the frame from the side of the frame, where the side of the frame is provided with the side plate, wherein the side plate, in its upper position, is configured to provide access to the one or more screen modules fastened to the frame and to the drive, positioning or fastening means for the one or more screen modules.

5. The screen according to claim 1, wherein the side plate, in its lower position, is configured to constitute an side plate for the disc screen, and encapsulate one or more screen modules and the drive, positioning or fastening means for the one or more screen modules.

6. A screen comprising a frame, and one or more screen modules, which one or more screen modules comprise shaft assemblies and a wall having an upper part, a lower part, and a side part connecting the upper part and the lower part of the wall, and to which wall the shaft assemblies are connected, wherein the frame comprises a side plate which, in its lower position, is configured to lock one or more screen modules against the frame so that the part of the lateral side plate abutting the upper part of the wall presses the screen module downwards and the lower part of the wall against the frame, and, in its upper position, is configured to enable detaching one or more screen modules from the screen, or attaching and replacing one or more screen modules to the frame, wherein the side plate comprises an element, which is a part of the side plate, and wherein the element is placed between the side plate and the upper part of the wall of the screen module.

7. The screen according to claim 6, wherein the shape of the element corresponds to the shape of the upper part of the wall of the screen module and the abutting corner, side or edge parts adjacent to it, or the element has the shape of a U opening downwards.

8. The screen according claim 1, wherein the frame comprises one or more positioning elements arranged on a longitudinal side of the frame provided with the side plate.

9. The screen according to claim 1, wherein the frame comprises positioning elements, and wherein the screen module comprise positioning elements so that a positioning element of the frame is configured to be placed against a positioning element of a screen module placed or to be placed in the frame.

10. A screen comprising a frame, and one or more screen modules, which one or more screen modules comprise shaft assemblies and a wall having an upper part, a lower part, and a side part connecting the upper part and the lower part of the wall, and to which wall the shaft assemblies are connected, wherein the frame comprises a side plate which, in its lower position, is configured to lock one or more screen modules against the frame so that the part of the lateral side plate abutting the upper part of the wall presses the screen module downwards and the lower part of the wall against the frame, and, in its upper position, is configured to enable detaching one or more screen modules from the screen, or attaching and replacing one or more screen modules to the frame, wherein the wall of the screen module comprises a horizontal upper part, a horizontal lower part and a vertical side part connecting these, and wherein the shaft assemblies are connected to the side part of the wall, and at least one or more positioning elements are placed in the horizontal lower part of the wall which is placed against the frame so that one or more positioning elements of the frame and the screen module are placed against each other, constituting a pair of mating parts.

11. The screen according to claim 1, comprising a screen module comprising adjacent shafts provided with screening elements and rotated by means of a drive element at the end of each shaft assembly, and wherein the screen module comprises a wall to which the shaft assemblies are fastened so that the drive elements and the screening elements are arranged on different sides of the wall.

12. The screen according to claim 1, comprising one or more motors fastened to the frame of the screen.

13. The screen according to claim 12, wherein the transmission of one or more motors to the screen module is configured to be disengaged by quick release.

14. The screen according to claim 1, comprising one or more motors, and wherein the torque of one or more motors is transmitted to the drive element of the screen module, and wherein the drive elements are placed at the ends of the shaft assemblies of the screen module and are connected to each other in by a belt or a chain.

15. The screen according claim 1, comprising one or more motors are configured to be used for driving the drive element of each shaft assembly of the screen module, one drive element of the screen module, or the outermost drive element of the screen module, or adjacent drive elements of two adjacent screen modules.

16. The screen according claim 1, comprising a side plate on the maintenance side of the screen as well.

* * * * *